US008904940B1

(12) United States Patent
Pann et al.

(10) Patent No.: US 8,904,940 B1
(45) Date of Patent: Dec. 9, 2014

(54) GRENADE WITH TIME DELAY

(75) Inventors: Sokha Pann, Fredericksburg, VA (US); Samuel R. Koski, Bowling Green, VA (US); John F. Busic, King George, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 13/554,151

(22) Filed: Jul. 20, 2012

(51) Int. Cl.
*F42B 8/12* (2006.01)
*F42B 12/46* (2006.01)
*F42B 27/00* (2006.01)

(52) U.S. Cl.
CPC . *F42B 27/00* (2013.01); *F42B 8/12* (2013.01); *F42B 12/46* (2013.01)
USPC ..... 102/368; 102/370; 102/498; 102/502; 102/512; 124/74; 124/71; 434/11; 473/571; 446/405

(58) Field of Classification Search
USPC ..... 102/367, 368, 369, 370, 482, 498, 502, 102/512, 513; 124/55, 60, 69, 71, 74; 434/11; 473/571; 446/405
See application file for complete search history.

(56) References Cited

U.S. PATENT DOCUMENTS

| | | | | |
|---|---|---|---|---|
| 4,667,601 | A * | 5/1987 | Diamond et al. | 102/368 |
| 6,209,461 | B1 * | 4/2001 | Riffet et al. | 102/513 |
| 6,250,226 | B1 * | 6/2001 | Leichter et al. | 102/370 |
| 7,191,708 | B2 * | 3/2007 | Ouliarin | 102/502 |
| 7,261,041 | B2 * | 8/2007 | Brock | 102/498 |
| 7,317,662 | B2 * | 1/2008 | Unsworth et al. | 367/144 |
| 7,752,974 | B2 * | 7/2010 | Wenaas et al. | 102/367 |
| 2013/0115574 | A1 * | 5/2013 | Hatcher | 434/11 |

* cited by examiner

*Primary Examiner* — James S Bergin
(74) *Attorney, Agent, or Firm* — Gerhard W. Thielman, Esq.

(57) ABSTRACT

A grenade device produces a delayed bang upon coupling to a pressurized canister containing gas. The device includes an annular housing, an awl, a sleeve, a diaphragm, a base and a cap. The housing has first and second axial ends and an internal bulkhead disposed therebetween with a choke flow-through orifice. The awl extends axially outward from the bulkhead. The sleeve connects to the housing at the first axial end. The diaphragm is disposed between the sleeve and the housing to form an annular chamber. The cap inserts into the housing at the second axial end and receives the canister facing the awl. The base connects to the housing at the second axial end. When the canister is compressed towards the device the awl punctures the canister to release the gas, which flows through the choke orifice to pressurize the chamber, and the diaphragm ruptures upon exceeding a pressure threshold.

12 Claims, 3 Drawing Sheets

GRENADE WITH TIME DELAY

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to devices that produce a loud but delayed sudden noise, such as a bang. In particular, the invention relates to a device, such as a grenade, that rapidly expands a compressed gas to produce a high-amplitude acoustic signal after a controllable interval from its activation event.

SUMMARY

Conventional flash-bang grenades yield disadvantages addressed by various exemplary embodiments of the present invention, such as controlled delay and specific noise level. Moreover, such devices are not modular, such that the components cannot be reused and reassembled.

In particular, various embodiments provide a modular grenade device to produce a delayed bang upon coupling to a pressurized canister that contains gas. The device includes an annular housing, a puncture awl, a sleeve, a diaphragm, a base and a cap. The housing has first and second axial ends and an internal bulkhead disposed therebetween. The bulkhead has a choke flow-through orifice. The awl extends axially outward from the bulkhead at the second axial end.

In various embodiments, the sleeve removably connects to the housing at the first axial end. The diaphragm is disposed between the sleeve and the housing to form an annular chamber between the diaphragm and the bulkhead. The cap inserts into the housing at the second axial end. The cap receives the canister so as to face the awl. The base removably connects to the housing at the second axial end. In response to axial compression of the canister towards the device: the awl punctures the canister to release the gas, the gas flows through the choke orifice to pressurize the chamber, and the diaphragm ruptures upon exceeding a pressure threshold in the chamber.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Various exemplary embodiments provide a delayed bang projectile (DBP) device as a grenade equipped with a controllable time interval between an activation event and the resulting action, i.e., rapid expansion. The DBP device has been developed as a non-lethal payload for an existing grenade launcher projectile. The DBP device has been designed to be safe during loading and handling, and activates due to either the setback forces imposed on the system after firing, or the force due to impact with the target. As is the case with most noise-making devices, the DBP device has been designed so as to have a time delay before making the noise, so that it can be positioned some distance from the operator after initial activation.

Figures 1A, 1B:
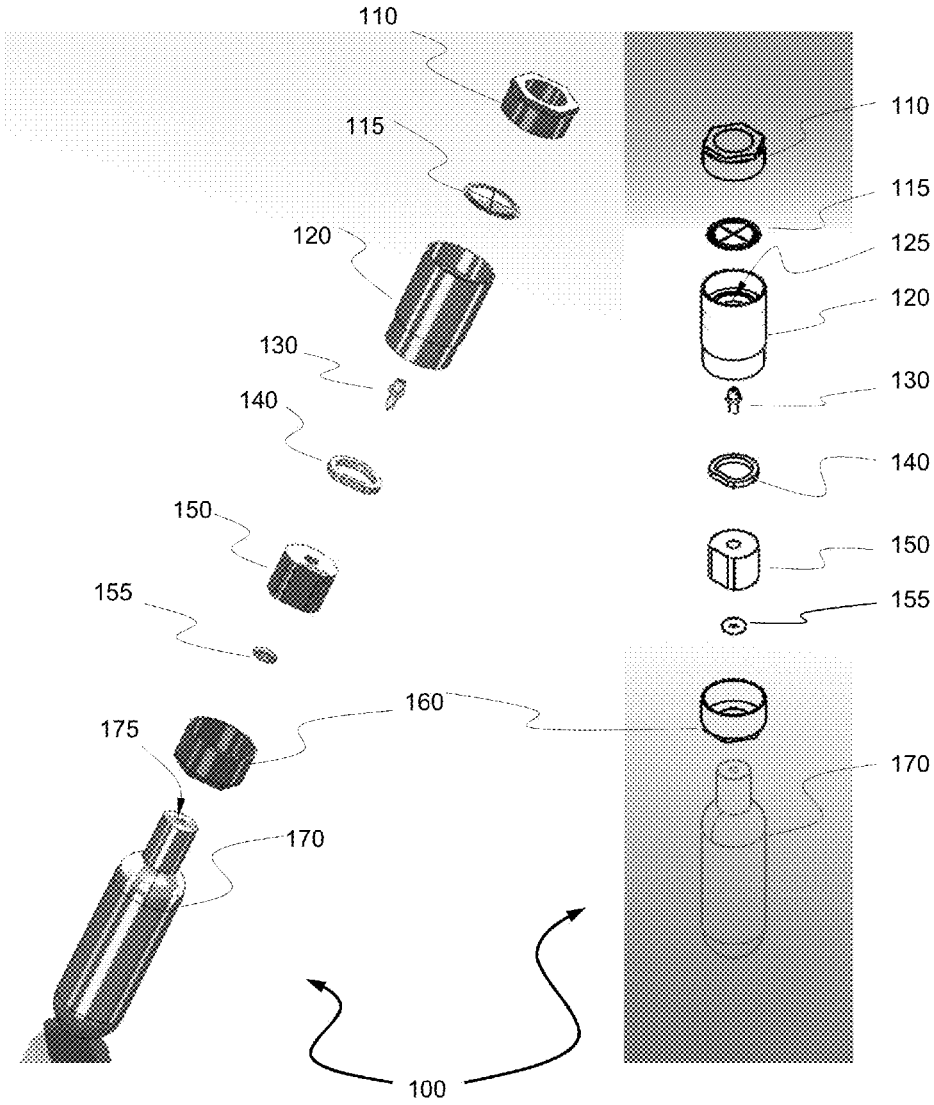
FIGS. 1A and 1B are exploded isometric views of components for a delayed bang projectile (DBP) device.

FIGS. 1A and 1B show exploded isometric views 100 of delayed bang projectile (DBP) device disposed along a longitudinal axis. The components include an upper hexagonal sleeve 110, a circular diaphragm disk 115, an annular housing 120, a flange pin 130, a rubber gasket 140, a canister cap 150, an o-ring 155, a lower hexagonal mount base 160, and a pressurized carbon dioxide canister 170, also called a cartridge or bottle.

The housing 120 has proximate and distal ends along the axis, with the sleeve 110 attaching by screw-threaded interfaces to the proximate end, and the base 160 attaching by screw-threaded interfaces to the distal end. Leland 8-gram carbon dioxide ($CO_2$) cartridges are commonly used in paintguns to propel marker balls and in pellet pistols to fire BB-pellets, as well as to provide carbonation for soda water, although other manufacturers also supply such cartridges. Each "sparklet" cartridge has a length of 2.56 inches and a diameter of Ø0.71 inch, weighs about 0.86 oz (24.5 g) and can maintain a pressure of 850 psi for storing compressed $CO_2$. These are preferably suitable to serve as the canister 170 to provide pressurized gas to activate the DPB device. Alternatively, custom-filled cartridges that store compressed helium (He) or nitrogen ($N_2$) can be employed for such purposes without departing from the scope of the claims.

Figure 2:
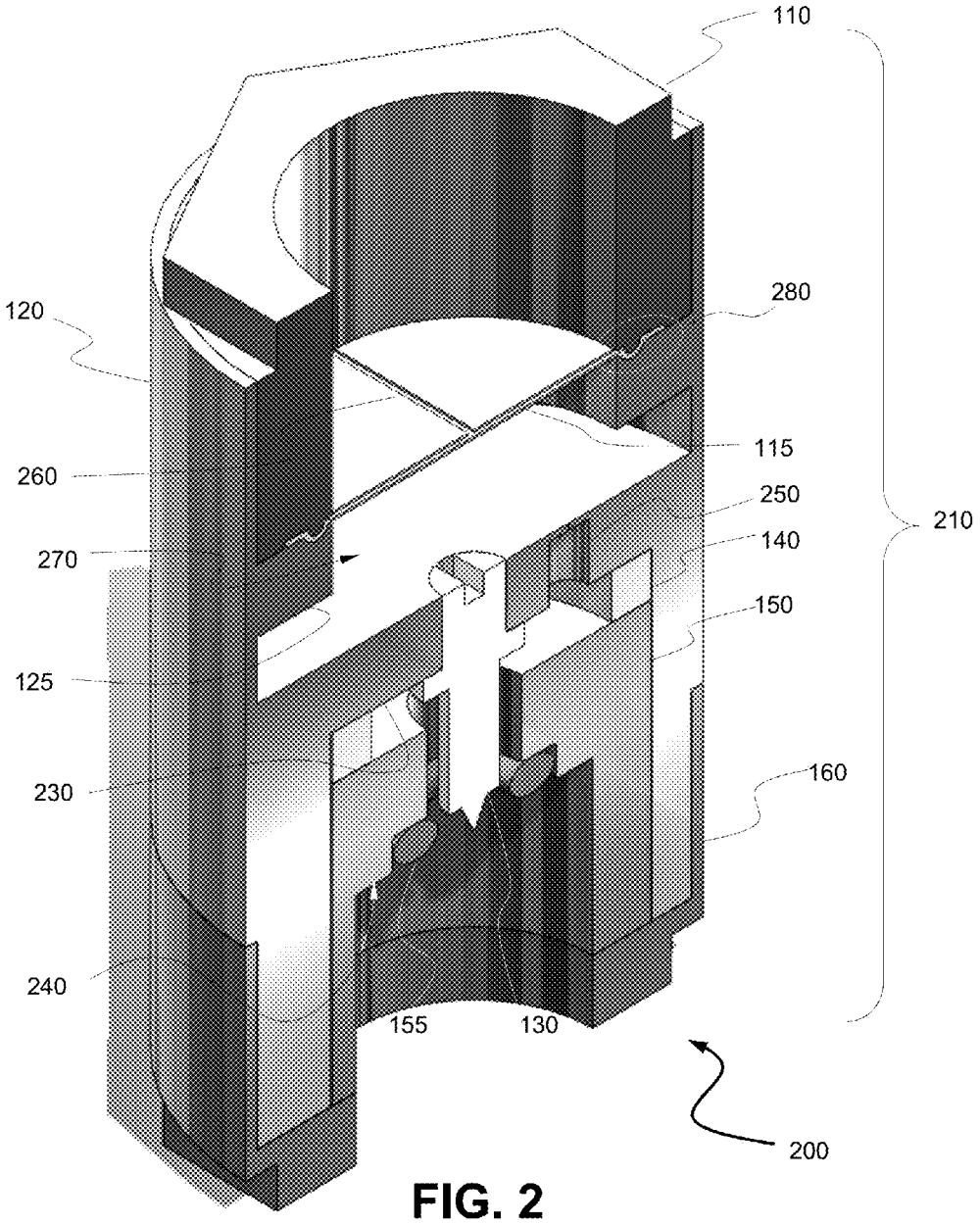
FIG. 2 is an isometric cross-section view of a DBP subassembly.

FIG. 2 shows an isometric cross-sectional view 200 of the DBP sub-assembly 210. The upper sleeve 110 within the housing 120. The diaphragm disk 115 is disposed between sleeve 110 and an upper annular ledge 220 on the housing 120. The gasket 140 is disposed between a cylindrical bulkhead 230 and the cap 150 within the housing 120. The canister 170 attaches at its muzzle to the DBP subassembly 210 facing a lower ledge 240 of the cap 150 that surrounds the o-ring 155. The pin 130 is secured at its proximal end through the bulkhead 230 includes a puncture point or awl at its distal end to release the pressurized $CO_2$ gas from the canister 170. Preferably the pin 130 serves as an awl or punch for puncturing the canister 170 at its top near the neck. The pin 130 screws into the bulkhead 230 to facilitate replacement during testing. The canister 170 is cushioned from the cap 150 by the o-ring 155.

A recess orifice 250 (divided into larger and smaller diameter segments) traverses through the bulkhead 230 adjacent the pin 130. The recess orifice 250 provides a constraint for choked gaseous flow, being limited to sonic velocity. The diaphragm disk 115 includes cruciform indentations or grooves 260 to weaken its structure along these rupture fault lines. A chamber 270 resides between the diaphragm disk 115 and the bulkhead 230. After the pin 130 punctures the canister 170, the chamber 270 fills with $CO_2$ gas, the pressure rise rate within being attenuated by the recess orifice 250 until the diaphragm disk 115 ruptures along the grooves 260. Along its circumferential edge, the diaphragm disk 115 includes a protrusion between the sleeve 110 and the housing 120, indicated within the oval region 280. This protrusion serves for assembly alignment and leakage mitigation.

For exemplary embodiments, most of the components, such as sleeve 110, housing 120, cap 150 and base 160 are made of stainless steel 304. The pin 130 comprises mirraloy or steel. Exceptions to this include diaphragm disk 115, gasket 140 and o-ring 155. Exemplary diaphragm disks 115 comprise either Mylar or aluminum depending on performance objectives. The gasket 140 and o-ring 155 are made of rubber.

Figures 3A, 3B:
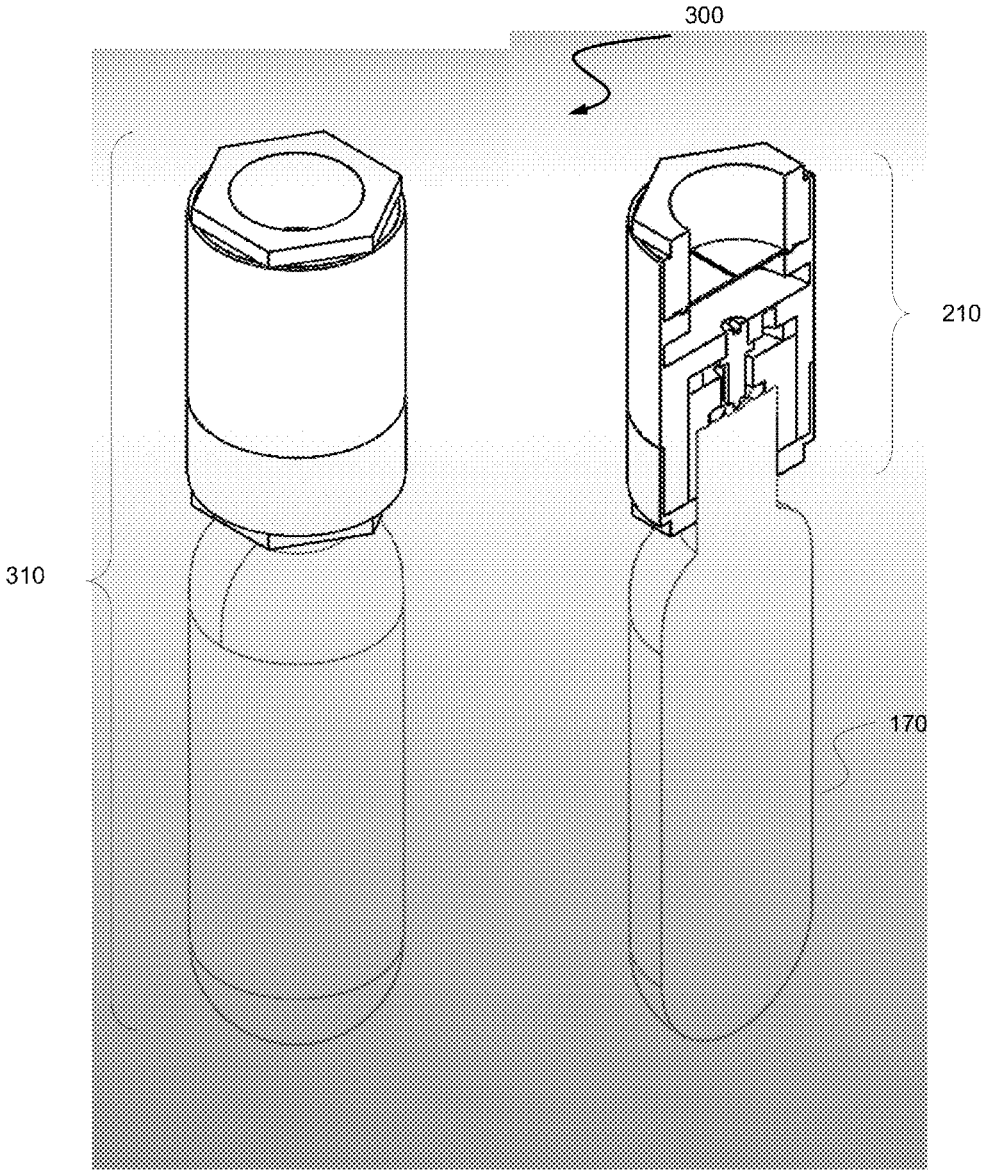
FIGS. 3A and 3B are isometric assembly and cross-section views of the DBP device.

FIGS. 3A and 3B show isometric views 300 of the DBP subassembly 210 installed with the canister 170 as a DBP device 310. FIG. 3A shows an assembly view of the assembly 310. FIG. 3B shows a cross-section view of the DBP device 310. The canister 170 inserts into the cap 150, preferably via threaded interfaces, and can translate axially fore and aft, as the gasket 140 and the o-ring 155 can be elastically compressed along that direction enabling the cap 150 to press towards the bulkhead 230 and thereby the canister 170 into the pin 130. The gasket 140 above the cap 150 is optional depending on the application, but preferably aids in shock mitigation at impact after firing the DBP device 310 from a gun.

An exemplary design of the DBP device 310 includes the following dimensions. The housing 120 preferably has an axial length of 1.05 inches and an outer diameter of Ø0.725 inch. The sleeve 110 and the base 160 have threaded interface diameters of Ø0.6875-24UNF-2A (to connect with the housing 120) with ⅝ inch hex rim, respective inner diameters of Ø0.450 inch and Ø0.375 inch and respective axial lengths of 0.315 inch and 0.385 inch respectively. The cap 150 has an outer diameter of Ø0.560 inch with a chamfer (of 0.055 inch chord depth), an inner threaded recess diameter of Ø0.375-24UNF-2B, a through-hole diameter of Ø0.150 inch, and a length of 0.440 inch.

Exemplary diaphragm disks 115 have thicknesses of alternatively 0.012 and 0.014 inch. In the examples tested, the diaphragm disk 115 includes cruciform indentations or grooves 260 milled into the material at approximately 0.004 inch. The resulting etched thickness of about 0.009 inch, coupled with the pressure from the canister 170 and the blow-down rate through the recess orifice 250, directly affects the time delay interval and sound intensity of the DBP device 310. For the configuration shown, the diaphragm 115 fails along the grooves 260 at less than the 850 psi deliverable by the canister 170, depending on the desired sound intensity and time delay. Field and lab testing produced time delays up to 2 minutes upon initiation, and sound intensities of 147 dB.

Control of both the time delay and the sound intensity are functions of the storage pressure of the canister 170, the diameter of the recess orifice 250, material of the diaphragm disk 115, and the diaphragm score depth along the grooves 260. The recess orifice preferably has a diameter of Ø50-micron (about 0.002 inch) for the smaller portion, or a choke-flow area of $3\times10^{-6}$ square inch. An alternative diameter is Ø0.0156 inch. Assuming substantially constant storage pressure of the canister 170, the recess orifice 250 controls the blow-down into the chamber 270 just below the diaphragm disk 115. With this flowrate established, the optimal manner to control time delay and sound intensity involves tailoring a diaphragm disk 115 to rupture at a given pressure.

Various exemplary embodiments provide a loud blast or bang type noise to be produced at a given time after impact. The DBP subassembly 210 includes a rupture diaphragm or burst disk 115 and a pressurized container, such as a typical commercial off-the-shelf (COTS) $CO_2$ 8-gram canister 170. The delay time and amplitude of the sound created by the DBP device 310 can be tailored by selecting the appropriate diaphragm disk 115 and container pressure. Due to the compact size of the complete assembly, the DBP device 310 can be installed in any number of housings, ranging from hand-throw type devices to munitions fired from a weapon.

The DBP device 310 is assembled as shown in exploded view 100. The instructions below describe a process by which to assemble and therefore use the DBP device 310:

1. Install the flange pin 130 into the annular housing 120 and tighten.
2. Install the rubber gasket 140 on the annular housing 120.
3. Install the canister cap 150 on the gasket 140 in the housing 120.
4. Install an o-ring 155 in the canister cap 150.
5. Install the lower hexagonal base 160 on the annular housing 120 and tighten along the screw threads.
6. Install the diaphragm disk 115 on the annular housing 120.
7. Install the upper hexagonal sleeve 110 on the diaphragm disk 115 and tighten along the internal screw threads.

Upon assembly of the DBP device 310, the diaphragm disk 115 is captured between the annular housing 120 and upper hexagonal sleeve 110. These pieces include a groove and matching protrusion, shown in region 280, thereby preventing leakage around edges of the diaphragm disk 115 when under pressure and also prevent the diaphragm disk 115 from being pushed out prior to rupture. The pressurized canister 170 is threaded into the canister cap 150, ensuring the o-ring 155 is properly disposed to prevent pressure leakage.

Upon impact at either end of the DBP device 310, the assembled canister cap 150 and canister 170 translate to impinge against the flange pin 130, thereby puncturing the canister 170. Then, $CO_2$ gas escapes the canister 170 and forces through a very small hole in the recess orifice 250 in the bulkhead 230 of the annular housing 120 disposed below the diaphragm disk 115. This hole controls the flowrate of the gas and can be sized depending upon its choke-flow diameter and pressure in the canister 170. The chamber 270 pressurizes, and subsequently ruptures the diaphragm disk 115 along the grooves 260.

The DBP device 310 can be tailored to a number of applications depending on the desired sound level and delay. Due to its compact size, the DBP device 310 can be packaged for a wide range of applications, alternatively scaled using substantially congruent components. Crowd control, training, and a range of war fighting applications can benefit from this technology, having been developed for a Department of Defense (DoD) program as a non-lethal capability. The DBP device 310 has demonstrated effectiveness during range testing and is being promoted to outside vendors. Due to its simplicity and range of application, the DBP device 310 can be easily tailored to a wide range of projectile platforms.

Components of the DBP device 310 are reusable after disassembly, with the exception of the diaphragm disk 115 (after rupture) and the canister 170, being scalable to increased or decreased sizes. The DBP 310 device can be packaged in a wide range of applications, constitutes a simple, safe mechanical assembly, and can be sized to function in different configurations, such as a multi bang hand throw grenade. The DBP device 310 can be coupled with other technologies, such as mal-odorants placed in the pressurized container, or iron-sulphide powder, which flash brightly when in contact with air (flash-bang device).

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. A grenade device for providing a delayed bang upon coupling to a pressurized canister containing gas, said device comprising:

an annular housing having first and second axial ends and an internal cylindrical bulkhead disposed therebetween, said bulkhead having choke flow-through orifice;

a puncture awl extending axially outward from said bulkhead at said second axial end;

a sleeve removably connecting to said housing at said first axial end;

a diaphragm disposed between said sleeve and said housing to form an annular chamber between said diaphragm and said bulkhead;

a cap inserting into said housing at said second axial end, said cap receiving the canister that faces said awl; and a base removably connecting to said housing at said second axial end, wherein in response to axial compression of the canister towards the device:

said awl punctures the canister to release the gas, the gas flows through said choke orifice to pressurize said chamber, and said diaphragm ruptures upon exceeding a pressure threshold in said chamber.

2. The grenade device according to claim 1, wherein the canister is an 8-gram carbon dioxide cartridge.

3. The grenade device according to claim 1, wherein said sleeve, housing, said cap and said base are composed of stainless steel, and said diaphragm is composed of one of Mylar and aluminum.

4. The grenade device according to claim 1, wherein said diaphragm further includes at least one indentation for structural weakening.

5. The grenade device according to claim 4, wherein said diaphragm has a thickness of 0.013±0.001 inch, with said indentation having a depth of about 0.004 inch.

6. The grenade device according to claim 1, wherein said flow-through orifice includes a portion having a choke-flow area of $3\times10^{-6}$ square inch.

7. The grenade device according to claim 1, further including a gasket between said bulkhead and said cap and an o-ring between said cap and the cartridge.

8. The grenade device according to claim 7, wherein said gasket and said o-ring are composed of rubber.

9. The grenade device according to claim 1, wherein said housing has an axial length of 1.05 inches and an outer diameter of Ø0.725 inch.

10. The grenade device according to claim 1, wherein said sleeve and said base each have a ⅝ inch hex rim.

11. The grenade device according to claim 1, wherein said sleeve, housing, said cap and said base are composed of stainless steel, and said diaphragm is composed of Mylar.

12. The grenade device according to claim 1, wherein said sleeve, housing, said cap and said base are composed of stainless steel, and said diaphragm is composed of aluminum.

* * * * *